US011589636B2

(12) United States Patent
Snyder

(10) Patent No.: US 11,589,636 B2
(45) Date of Patent: Feb. 28, 2023

(54) FLEXIBLE SHOE

(71) Applicant: Todd Snyder, Laguna Niguel, CA (US)

(72) Inventor: Todd Snyder, Laguna Niguel, CA (US)

( * ) Notice: Subject to any disclaimer, the term of this patent is extended or adjusted under 35 U.S.C. 154(b) by 10 days.

(21) Appl. No.: 17/218,518

(22) Filed: Mar. 31, 2021

(65) Prior Publication Data

US 2022/0312884 A1 Oct. 6, 2022

(51) Int. Cl.

| | |
|---|---|
| ***A43B 1/00*** | (2006.01) |
| ***A43B 13/14*** | (2006.01) |
| ***A43B 23/02*** | (2006.01) |
| ***A43B 9/02*** | (2006.01) |

(52) U.S. Cl.

CPC ..... *A43B 1/0018* (2013.01); *A43B 9/02* (2013.01); *A43B 13/141* (2013.01); *A43B 23/027* (2013.01); *A43B 23/0295* (2013.01)

(58) Field of Classification Search

CPC ..... A43B 9/02; A43B 23/027; A43B 23/0295; A43B 3/08; A43B 3/10; A43B 3/106; A43B 3/107; A43B 3/108; A43B 3/248; A43B 5/08

See application file for complete search history.

(56) References Cited

U.S. PATENT DOCUMENTS

| | | | | | |
|---|---|---|---|---|---|
| 831,210 | A * | 9/1906 | Bosley | A43B 3/101 | 36/97 |
| 1,691,219 | A * | 11/1928 | Winn | A43B 3/16 | 36/51 |
| 1,989,613 | A * | 1/1935 | Disch | A43B 3/10 | 36/105 |
| 2,254,685 | A * | 9/1941 | Jackson | A43B 3/16 | 36/58.5 |
| 2,806,301 | A * | 9/1957 | Meltzer | A43B 3/10 | 36/9 R |
| 2,860,425 | A * | 11/1958 | Jackson | A43B 3/16 | 36/58.5 |
| 4,043,058 | A * | 8/1977 | Hollister | A43B 5/00 | 36/102 |
| 5,766,050 | A | 6/1998 | Maggi | | |

(Continued)

FOREIGN PATENT DOCUMENTS

| | | | |
|---|---|---|---|
| CN | 206294964 | U | 7/2017 |
| DE | 202005016841 | U1 | 3/2006 |
| EP | 3104730 | B1 | 10/2018 |

OTHER PUBLICATIONS

Fun Toes Barefoot Water Skin Shoes Aqua Socks for Beach Pool Sand Swim Surf Yoga Water Aerobics; https://www.mensgearandfashion.com/15-greatest-womens-shoes/?.

*Primary Examiner* — Ted Kavanaugh

(74) *Attorney, Agent, or Firm* — Barnes & Thornburg LLP

(57) ABSTRACT

A flexible shoe includes an under sole, a foot bed, a first over-foot portion, and a second over-foot portion. The under sole is formed of ballistic nylon. The foot bed is arranged on an upper surface of the under sole. The first over-foot portion is attached to the under sole and is configured to flexibly overly an instep of a foot of a user forward of an ankle of the user. The second over-foot portion is configured to flexibly wrap around a heel of the user rearward of the ankle of the user. The under sole, the first over-foot portion, and the second over-foot portion define a cavity configured to enclose the foot of the user. The foot bed is positioned entirely within the cavity.

18 Claims, 3 Drawing Sheets

(56) References Cited

U.S. PATENT DOCUMENTS

| | | | | |
|---|---|---|---|---|
| 6,182,377 | B1 | 2/2001 | Toensing | |
| 2008/0010862 | A1* | 1/2008 | Richardson | A43B 3/128 36/105 |
| 2014/0202035 | A1 | 7/2014 | Goldman et al. | |
| 2015/0223564 | A1* | 8/2015 | Peyton | A43B 13/184 36/28 |
| 2015/0264996 | A1 | 9/2015 | Rodriguez | |
| 2018/0064210 | A1* | 3/2018 | Turner | A43B 23/025 |
| 2019/0059505 | A1 | 2/2019 | Ohlin | |
| 2019/0297988 | A1* | 10/2019 | Oden | A43B 3/244 |

* cited by examiner

FLEXIBLE SHOE

BACKGROUND

The present disclosure relates to footwear. More particularly, the present disclosure relates to flexible footwear.

SUMMARY

According to the present disclosure, a flexible shoe includes an under sole formed of ballistic nylon, a foot bed arranged on an upper surface of the under sole, a first over-foot portion attached to the under sole and configured to flexibly overly an instep of a foot of a user forward of an ankle of the user, and a second over-foot portion configured to flexibly wrap around a heel of the user rearward of the ankle of the user.

In the illustrative embodiments, the under sole, the first over-foot portion, and the second over-foot portion define a cavity configured to enclose the foot of the user. The foot bed is positioned entirely within the cavity.

In at least some embodiments, an outer perimeter edge of the first over-foot portion that corresponds to an outer perimeter edge of the under sole is fixedly attached to an entirety of a first portion of the outer perimeter edge defined by a forward two-thirds of a forward to rearward length of the under sole.

In some embodiments, a first outer side edge and a second outer side edge of the second over-foot portion that correspond to a first outer side perimeter edge and a second outer side perimeter edge of the under sole are fixedly attached to the first and second outer side perimeter edges, respectively, such that a gap is formed between a bottom edge of the second over-foot portion and a heel portion of the outer perimeter edge of the under sole.

In the illustrative embodiments, the second over-foot portion is sized to extend from a top of a heel bone of the user to the heel portion of the outer perimeter edge of the under sole in response to the foot of the user being arranged in the flexible shoe.

In at least some embodiments, a height of the second over-foot portion defined by a distance between a center point of a top edge of the second over-foot portion and a center point of the bottom edge of the second over-foot portion is equal to one-quarter of the forward to rearward length of the under sole.

In some embodiments, the first over-foot portion and the second over-foot portion are flat-stitched to the outer perimeter edge of the under sole with a stitching material, the stitching material being resiliently expandable and contractible.

In the illustrative embodiments, a rear edge of the first over-foot portion that extends from the first outer side perimeter edge of the under sole to the second outer side perimeter edge of the under sole is configured to flexibly surround a forward portion of the ankle of the foot of the user, and wherein a top edge of the second over-foot portion that extends from the first outer side perimeter edge of the under sole to the second outer side perimeter edge of the under sole is configured to flexibly surround a rear portion of the ankle of the foot of the user.

In at least some embodiments, a rearmost point at which the rear edge of first over-foot portion attaches to the first outer side perimeter edge of the under sole is located rearward of a forwardmost point at which the top edge of the second over-foot portion attaches to the first outer side perimeter edge of the under sole, and wherein a rearmost point at which the rear edge of first over-foot portion attaches to the second outer side perimeter edge of the under sole is located rearward of a forwardmost point at which the top edge of the second over-foot portion attaches to the second outer side perimeter edge of the under sole.

In some embodiments, the foot bed is formed of neoprene.

In the illustrative embodiments, the first over-foot portion and the second over-foot portion are formed of stretch-fit rubber.

According to another aspect of the present disclosure, an under sole, a foot bed arranged on an upper surface of the under sole, a first over-foot portion attached to the under sole and configured to flexibly overly an instep of a foot of a user forward of an ankle of the user, an outer perimeter edge of the first over-foot portion that corresponds to an outer perimeter edge of the under sole being fixedly attached to an entirety of an outer perimeter edge of a forward two-thirds of a forward to rearward length of the under sole, and a second over-foot portion configured to flexibly wrap around a heel of the user rearward of the ankle of the user, a first outer side edge and a second outer side edge of the second over-foot portion that correspond to a first outer side perimeter edge and a second outer side perimeter edge of the under sole being fixedly attached to the first and second outer side perimeter edges, respectively, such that a gap is formed between a bottom edge of the second over-foot portion and a heel portion of the outer perimeter edge of the under sole.

In at least some embodiments, the under sole, the first over-foot portion, and the second over-foot portion define a cavity configured to enclose the foot of the user, the foot bed is positioned entirely within the cavity, and the second over-foot portion is sized to extend from a top of a heel bone of the user to the heel portion of the outer perimeter edge of the under sole in response to the foot of the user being arranged in the flexible shoe.

In some embodiments, a height of the second over-foot portion defined by a distance between a center point of a top edge of the second over-foot portion and a center point of the bottom edge of the second over-foot portion is equal to one-quarter of the forward to rearward length of the under sole.

In the illustrative embodiments, the under sole is formed of ballistic nylon.

In at least some embodiments, the foot bed is formed of neoprene.

In some embodiments, the first over-foot portion and the second over-foot portion are formed of stretch-fit rubber.

In the illustrative embodiments, the first over-foot portion and the second over-foot portion are flat-stitched to the outer perimeter edge of the under sole with a stitching material, the stitching material being resiliently expandable and contractible.

In at least some embodiments, a rear edge of the first over-foot portion that extends from the first outer side perimeter edge of the under sole to the second outer side perimeter edge of the under sole is configured to flexibly surround a forward portion of the ankle of the foot of the user, and wherein a top edge of the second over-foot portion that extends from the first outer side perimeter edge of the under sole to the second outer side perimeter edge of the under sole is configured to flexibly surround a rear portion of the ankle of the foot of the user.

In some embodiments, a rearmost point at which the rear edge of first over-foot portion attaches to the first outer side perimeter edge of the under sole is located rearward of a forwardmost point at which the top edge of the second over-foot portion attaches to the first outer side perimeter edge of the under sole, and wherein a rearmost point at which the rear edge of first over-foot portion attaches to the second outer side perimeter edge of the under sole is located rearward of a forwardmost point at which the top edge of the second over-foot portion attaches to the second outer side perimeter edge of the under sole.

According to another aspect of the present disclosure, a method for forming a flexible shoe includes forming an under sole from ballistic nylon, forming a foot bed, positioning the foot bed on an upper surface of the under sole, forming a first over-foot portion configured to flexibly overly an instep of a foot of a user forward of an ankle of the user, attaching the first over-foot portion to the under sole, and forming a second over-foot portion configured to flexibly wrap around a heel of the user rearward of the ankle of the user, the under sole, the first over-foot portion, and the second over-foot portion define a cavity configured to enclose the foot of the user. The foot bed is positioned entirely within the cavity.

In at least some embodiments, the method further includes flat-stitching the first over-foot portion and the second over-foot portion to the outer perimeter edge of the under sole with a stitching material, the stitching material being resiliently expandable and contractible.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a flexible shoe according to the present disclosure, showing the shoe arranged on a foot of a user and showing an under sole formed of ballistic nylon, a first over-foot portion attached to the under sole and configured to flexibly overly an instep of the foot of the user forward of an ankle of the user, and a second over-foot portion configured to flexibly wrap around a heel of the user rearward of the ankle of the user, and suggesting that the under sole, the first over-foot portion, and the second over-foot portion define a cavity configured to enclose the foot of the user, and that a foot bed is positioned entirely within the cavity;

FIG. 2 is a top view of the flexible shoe of FIG. 1, showing the profile of the under sole, the first over-foot portion, and the second over-foot portion without a foot of a user being arranged in the flexible shoe such that the first over-foot portion and the second over-foot portion are in a neutral, unstretched state, and suggesting that a gap is formed between a bottom edge of the second over-foot portion and a heel portion of the outer perimeter edge of the under sole, further suggesting that the top-edge of the second over-foot portion and the rear edge of the first over-foot portion surround the user's foot when the foot is arranged in the shoe, and further suggesting that the points at which the first over-foot portion attaches to the under sole are located rearward of the points at which the second over-foot portion attaches to the under sole;

DETAILED DESCRIPTION

Figure 1:
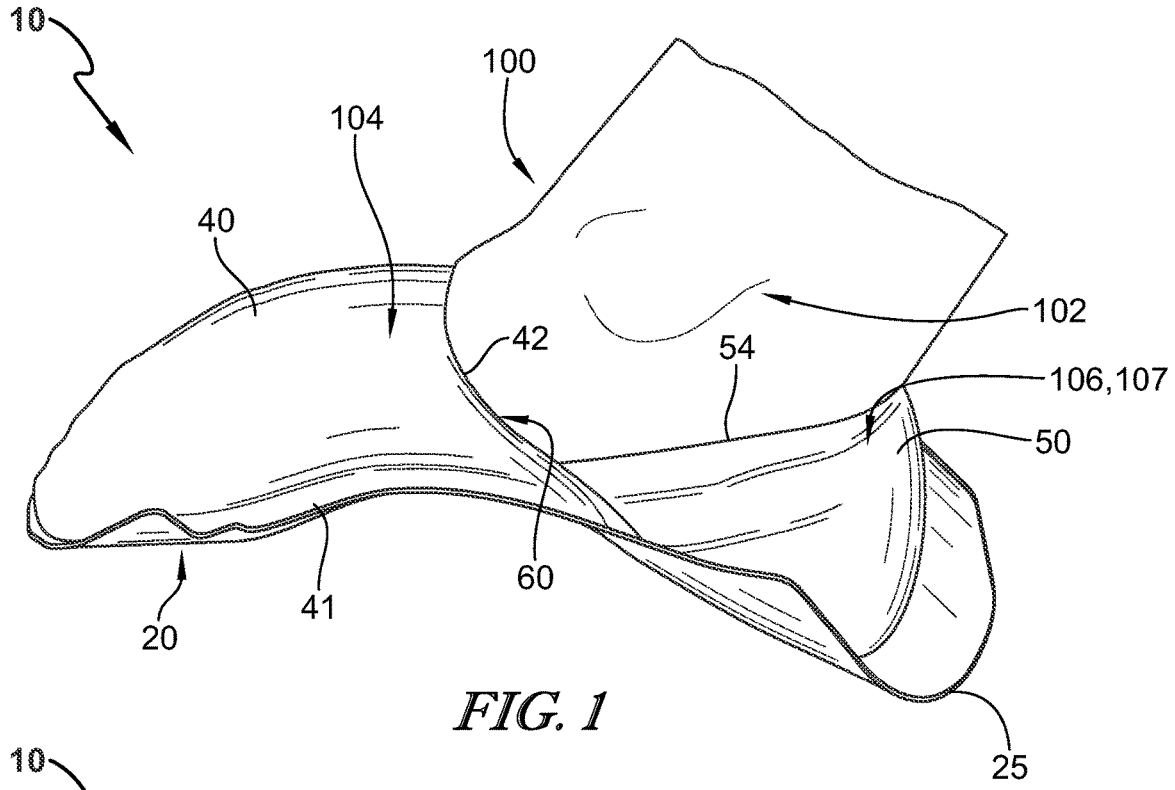

A first embodiment of a flexible shoe 10 in accordance with the present disclosure is shown in FIGS. 1-3D. A method 200 of forming the flexible shoe 10 is shown in FIG. 4. The flexible shoe 10 is configured to be worn on the foot 100 of a user, as shown in FIG. 1. The flexible shoe 10 includes an under sole 20, a foot bed 30 arranged on an upper surface 21 of the under sole 20, a first over-foot portion 40, and a second over-foot portion 50. The under sole 20, the first over-foot portion 40, and the second over-foot portion 50 define a cavity 60 configured to enclose the foot 100 of the user. The foot bed 30 is positioned on the upper surface 21 of the under sole 20 and entirely within the cavity 60.

Figure 2:
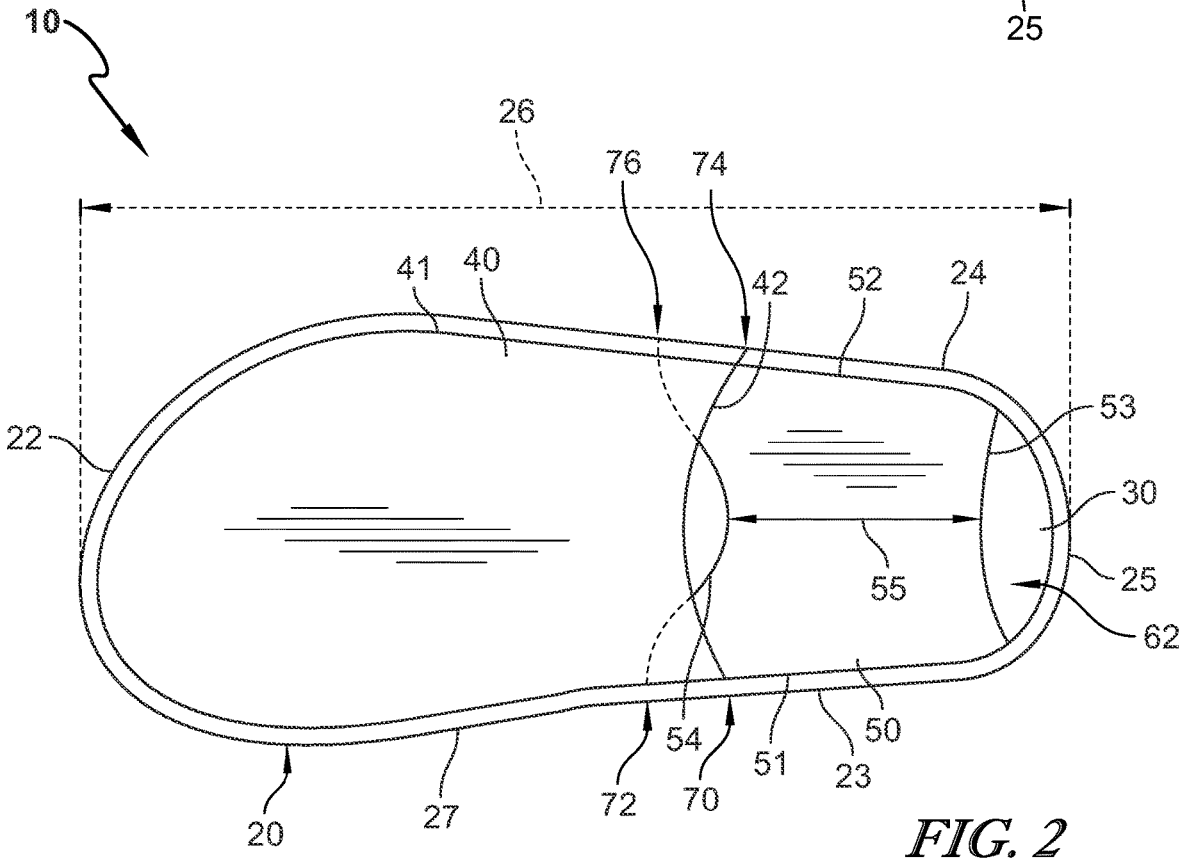

In the illustrative embodiment, the first over-foot portion 40 and the second over-foot portion 50 are formed of stretch-fit rubber. As a result, the first over-foot portion 40 and the second over-foot portion 50 are flexibly resilient in the plane of the material in that the stretch-fit rubber conforms to the foot 100 of the user when the foot 100 is inserted into the flexible shoe 10. For example, as can be seen in FIG. 2, the first over-foot portion 40 and the second over-foot portion 50 extend relatively coplanar with the under sole 20 in a neutral, unstretched state. When the foot 100 of a user is inserted into the flexible shoe 10 such that the first over-foot portion 40 and the second over-foot portion 50 overly the instep 104 and the heel 106 of the foot 100, the material of the first and second over-foot portions 40, 50 is stretched around the instep 104 and the heel 106 so as to tightly secure the foot 100 within the flexible shoe 10. When the foot 100 is removed from the flexible shoe 10, the first over-foot portion 40 and the second over-foot portion 50 return to the unstretched position shown in FIG. 2.

In the illustrative embodiment, the under sole 20 is formed of ballistic nylon material. Ballistic nylon material is a flexible, thick nylon fabric that provides significant abrasion resistance and durability. As a result, the bottom of the flexible shoe 10 is capable of withstanding interactions with highly abrasive, rough surfaces, thus allowing a user to traverse such surfaces with minimal wear on the flexible shoe 10. This, along with the increased durability of ballistic nylon, advantageously increases the longevity of the flexible shoe 10. Moreover, ballistic nylon is resiliently flexible so as to allow the under sole 20 and thus the foot 100 of the user to conform to irregularities of the surface being traversed, thus improving the user's ability to balance on and grip such surfaces. Even further, the thickness and flexibility of the under sole 20 allows the user to more clearly feel the features of the surface being traversed, giving the user a better sense of what he or she is walking over and how to effectively negotiate the surface.

The flexibility of the shoe 10 provided by the stretch-fit rubber and ballistic nylon, as well as the abrasion resistance and durability provided by the ballistic nylon, makes the flexible shoe 10 especially useful for wet or moist environments, in particular for underwater use. The flexibility of the materials enables the shoe to conform to the uneven surfaces typical of underwater environments, while the ballistic nylon provides for increased abrasion resistance and durability when the shoe 10 is used in environments with rough and uneven surfaces. Moreover, the stretch-fit rubber provides a tight, conforming fit to the user's foot 100, ensuring that the shoe 10 will not become dislodged from the user's foot 100 during use in such environments.

The flexible shoe 10 according to the present disclosure includes the under sole 20, the foot bed 30, the first over-foot portion 40, and the second over-foot portion 50, as shown in FIGS. 1-3D. The under sole 20 is generally thin and flat, and in some embodiments, is approximately 0.0625 to 0.125 inches thick. This minimal thickness of the under sole 20 allows for the flexible shoe 10 to remain flat and have a relatively small thickness when no foot is inserted in the shoe 10, as shown in FIG. 2. This allows for the flexible shoe 10 to be folded when not being used by the user, thus allowing the user to conveniently store the flat flexible shoe 10 in a small container such as the user's pocket. Moreover, the minimal thickness provides for reduced weight and bulk in the flexible shoe 10. The under sole 20 is shaped to correspond to the shape of a human foot, and is sized and shaped depending on the foot size of the intended user. In other words, the under sole 20 may be formed based on any shoe size corresponding to the size of any human foot.

Figures 3A, 3B, 3C, 3D:
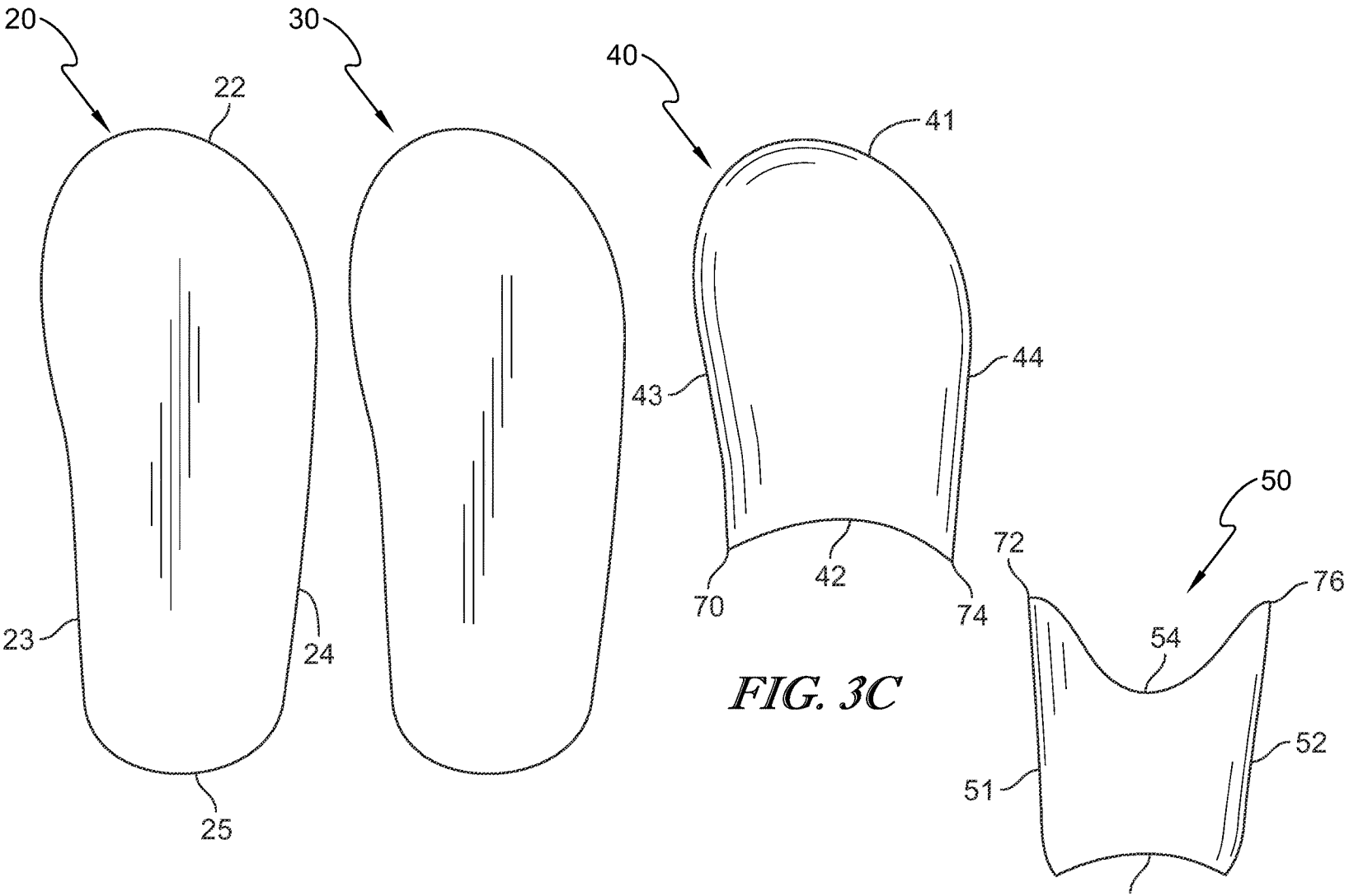
FIG. 3A is a top view of the under sole of the flexible shoe of FIGS. 1 and 2, showing the profile of the under sole.
FIG. 3B is a top view of the foot bed of the flexible shoe of FIGS. 1 and 2, showing the profile of the foot bed.
FIG. 3C is a top view of the first over-foot portion of the flexible shoe of FIGS. 1 and 2, showing the profile of the first over-foot portion in a neutral, unstretched state.
FIG. 3D is a top view of the second over-foot portion of the flexible shoe of FIGS. 1 and 2, showing the profile of the second over-foot portion in a neutral, unstretched state.
Figure 4:
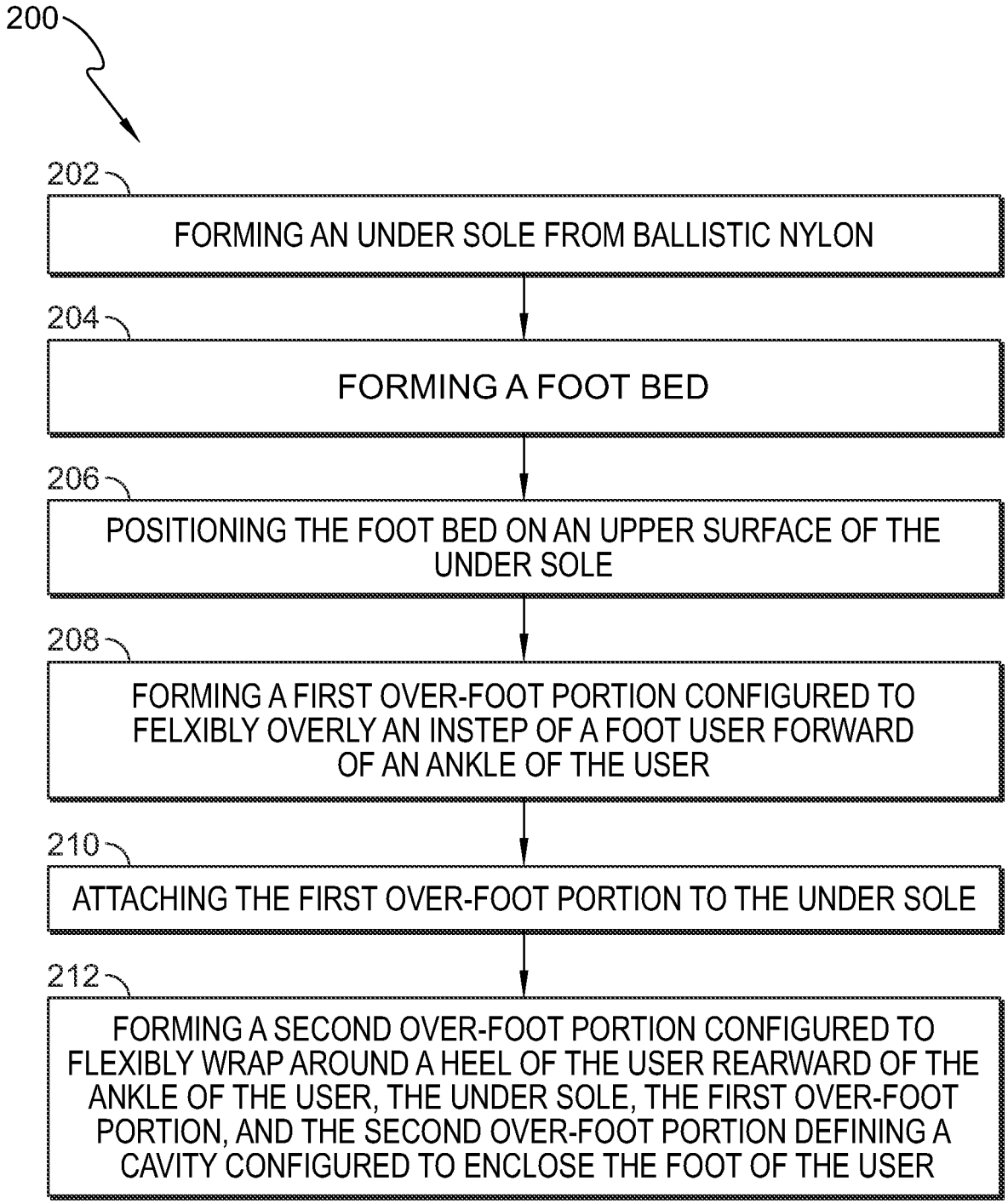
FIG. 4 is a method of forming a flexible shoe according to the present disclosure.

The under sole 20 defines an outer perimeter edge 22 around the outside of the under sole 20, as shown in FIGS. 2 and 3A. The outer perimeter edge 22 includes a first outer side perimeter edge 23 and a second outer side perimeter edge 24 opposite the first outer side perimeter edge 23. The outer perimeter edge 22 also includes a heel portion 25 located at the rear of the under sole 22 in the vicinity of where the heel 106 of the user's foot 100 is positioned when arranged in the flexible shoe 10. The length 26 of the under sole 20 is measured from a front tip of the under sole 20 to a rear tip of the under sole 20, as shown in FIG. 2.

As discussed above, the under sole 20 is formed of ballistic nylon material. Ballistic nylon is manufactured using a very high-denier nylon thread. Thread denier is a unit of weight used to measure the linear mass density of fibers, defined as the weight in grams of 9000 meters of thread. Ballistic nylon is typically manufactured from thread having above a 1000 d thread denier. Moreover, a "ballistic weave" is used to weave the thread into a fabric. Ballistic weave is a very tight and dense weave that maximizes the fabric's durability and tear resistance. Most commonly, a ballistic weave will utilize a 2×2 basket weave. The weave pattern is extremely resistant to tearing, while the high thread denier provides highly efficient abrasion resistance.

In addition to ballistic nylon, the under sole 20 may be formed of materials similar to ballistic nylon. For example, the under sole 20 may be formed of ripstop nylon, which includes reinforcement yarns that are interwoven at regular intervals in a crosshatch pattern. The intervals are typically 0.2 to 0.3 inches. The under sole 20 may also be formed of Cordura nylon, which includes nylon fabrics having 1000 d thread denier and a plain 1 over 1 weave. The under sole 20 may also be formed of Kodra nylon.

In addition to providing abrasion resistance and durability, the ballistic nylon material also allows for the under sole 20 to be resiliently flexible so as to accommodate various shapes of human feet as well as being able to conform to uneven surfaces upon which the user is walking. For example, as can be seen in FIG. 1, the middle portion of the under sole 20 is flexible so as to accommodate the shape of the sole and arch of the user's foot 100, while the rear of the under sole 20 is able to fold upwardly in response to the forces applied to the outer edges of the under sole 20 by the second over-foot portion 50. Moreover, ballistic nylon material will return to its original form after being flexed, so the flexible shoe 10 can adapt to various foot and surface shapes and subsequently return to the neutral, unstretched position shown in FIG. 2. In some embodiments, the front and rear portions of the under sole 20, which typically experience greater wear due to being the main points of contact with the ground surface, may comprise thicker pieces of ballistic nylon, while the arch portion of the under sole 20 comprises a thinner piece of ballistic nylon.

As can be seen in FIG. 3B, the foot bed 30 is shaped and sized to be nearly identical to the size and shape of the under sole 20. The foot bed 30 is generally thin and flat, and in some embodiments, is approximately 0.02 to 0.1 inches thick. This minimal thickness of the foot bed 30 allows for the flexible shoe 10 to remain flat and have a relatively small thickness when no foot is inserted in the shoe 10, as shown in FIG. 2. This allows for the flexible shoe 10 to be folded when not being used by the user, thus allowing the user to conveniently store the flexible shoe 10 in a small container such as the user's pocket. Moreover, the minimal thickness provides for reduced weight and bulk in the flexible shoe 10. The surface area of the foot bed 30 is slightly less than the surface area of the under sole 20 such that the foot bed 30 is able to fit within the cavity 60 defined by the under sole 20, the first over-foot portion 40, and the second over-foot portion 50. In some embodiments, the foot bed 30 is fixedly attached to the under sole 20, for example by stitching around the perimeter of the foot bed 30 to the under sole 20.

In the illustrative embodiment, the foot bed 30 is formed of neoprene. Neoprene is a strong synthetic rubber that is more resistant to water, oils, and other solvents than natural rubber. As such, the foot bed 30 is capable of being flexed so as to conform to various foot and surface shapes, similarly to the under sole 20. Similarly to the ballistic nylon material of the under sole 20, the neoprene material of the foot bed 30 is configured to return to original form after being flexed. Moreover, neoprene provides increased comfortability, particularly in scenarios in which a user will use the flexible shoe 10 in water. Specifically, a user will typically insert his or her bare foot 100 into the shoe such that the skin of the foot 100 directly contacts the upper surface of the foot bed 30. Neoprene provides extra comfort for the user when placed in direct contact with skin, in particular because the neoprene material does not irritate skin like other materials typically used in footwear. In some embodiments, the neoprene material may be GlideSkin neoprene. In other embodiments, the foot bed 30 may be formed of a material or materials similar to neoprene.

In the illustrative embodiment, the first over-foot portion 40 is fixedly attached to the under sole 20 and has an outer contour that substantially matches the outer contour of the under sole 20, as shown in FIGS. 2, 3A, and 3C. In particular, the first over-foot portion 40 defines an outer perimeter edge 41 that substantially corresponds to the outer perimeter edge 22 of the under sole 20, as shown in FIG. 2. In at least some embodiments, the outer perimeter edge 41 is stitched to the under sole 20 around the outer perimeter edge 22 of the under sole 20. The outer perimeter edge 41 is attached slightly inward of the outer perimeter edge 22 of the under sole 20 such that the under sole 20 includes a front portion of a ledge 27 formed between the outer perimeter edge 41 of the first over-foot portion 40 and the outer perimeter edge 22 of the under sole 20. The ledge 27 is larger at the rear of the shoe 10 in order to allow for additional support and protection of the user's foot 100.

In at least some embodiments the outer perimeter edge 41 is flat-stitched to the outer perimeter edge 22 of the under sole 20 with a stitching material, the stitching material being resiliently expandable and contractible. In some embodiments, the outer perimeter edge 41 is reverse overlock stitched onto the outer perimeter edge 22 of the under sole 20. In some embodiments, the outer perimeter edge 41 is over-stitched onto the outer perimeter edge 22 of the under sole 20. In some embodiments, the front edges of the flexible shoe 10 include a rubberized edge. A rubberized coating is applied over the stitching at the joint of the outer perimeter edge 41 and the outer perimeter edge 22 of the under sole 20. The rubberized coating hardens and forms a rubber seam that protects the stitching in high-stress environments.

The first over-foot portion 40 further includes a rear edge 42 that extends substantially transversely across the under sole 20 from the first outer side perimeter edge 23 of the under sole 20 to the second outer side perimeter edge 24, as well as a first outer side edge 43 and a second outer side edge 44, as shown in FIGS. 2 and 3C. The first over-foot portion 40 extends rearward from the front tip of the under sole 20 approximately two-thirds of the total length 26 of the under sole 20. In other words, the first and second side edges 43, 44 of the first over-foot portion 40 attach to the under sole 20 at respective rearmost first and second attachment points 70, 74 that are located approximately two-thirds of the total length 26 away from the front tip of the under sole 20. In at least some embodiments, the rear edge 42 is curved toward the front tip of the under sole 20 such that a center point of the curve of the rear edge 42 is located closer to the front of the under sole 20 than the attachment points 70, 74. Thus, the rear edge 42 more closely resembles the shape of the front portion of the ankle 102 of the user's foot 100, and as a result, more readily conforms to the front portion of the ankle 102. In some embodiments, the rear edge 42 includes a rubberized coating applied to the entire extent of the rear edge 42.

The first over-foot portion 40 is formed of stretch-fit rubber such that the first over-foot portion 40 is flexibly resilient in the plane of the material. Specifically, the stretch-fit rubber of the first over-foot portion 40 conforms to the foot 100 of the user when the foot 100 is inserted into the flexible shoe 10. The stretch-fit rubber has a biasing rate that biases the stretch-fit rubber to return to a neutral, unstretched state when not being stretched by the foot 100 of the user. The type of stretch-fit rubber used for the first over-foot portion 40 may be selected based on the necessary biasing rate of the application. As the stretch-fit rubber of the first over-foot portion 40 is stretched further away from its neutral, unstretched state, for example upwardly in a direction perpendicular to the resting plane of the first over-foot portion 40, the bias force forcing the material toward its unstretched state increases. Thus, the first over-foot portion 40 is configured to conform to any shape of foot 100 while contributing to securely holding the foot 100 in the flexible shoe 10.

In the illustrative embodiment, the second over-foot portion 50 is fixedly attached to the under sole 20 and has an outer contour that substantially matches the outer contour of the under sole 20, as shown in FIGS. 2, 3A, and 3D. In particular, the second over-foot portion 50 defines a first outer side edge 51 and a second outer side edge 52 that each substantially correspond to the outer perimeter edge 22 of the under sole 20 along their respective lengths, in particular the first and second outer side perimeter edges 23, 24 of the under sole 20, as shown in FIG. 2. In at least some embodiments, the first outer side edge 51 and the second outer side edge 52 are stitched to the under sole 20 along the respective lengths of the first and second outer side edges 51, 52. The first outer side edge 51 and the second outer side edge 52 are attached slightly inward of the first and second outer side perimeter edges 23, 24 of the under sole 20 such that the under sole 20 includes a rear portion of the ledge 27 formed between the first and second outer side edges 51, 52 of the second over-foot portion 50 and the first and second outer side perimeter edges 23, 24 of the under sole 20.

In at least some embodiments the first and second outer side edges 51, 52 are flat-stitched to the first and second outer side perimeter edges 23, 24 of the under sole 20 with a stitching material, the stitching material being resiliently expandable and contractible. In some embodiments, the first and second outer side edges 51, 52 are reverse overlock stitched onto the first and second outer side perimeter edges 23, 24 of the under sole 20. In some embodiments, the first and second outer side edges 51, 52 are over-stitched onto the first and second outer side perimeter edges 23, 24 of the under sole 20. In some embodiments, the rear edges of the flexible shoe 10 include a rubberized edge. A rubberized coating is applied over the stitching at the joint of the first and second outer side edges 51, 52 and the first and second outer side perimeter edges 23, 24 of the under sole 20. The rubberized coating hardens and forms a rubber seam that protects the stitching in high-stress environments.

The second over-foot portion 50 further includes a top edge 54 that extends substantially transversely across the under sole 20 from the first outer side perimeter edge 23 of the under sole 20 to the second outer side perimeter edge 24, as well as a bottom edge 53, as shown in FIGS. 2 and 3D. In at least some embodiments, the top edge 54 is curved toward the bottom edge 53 of the under sole 20 such that a center point of the curve of the top edge 54 is located closer to the heel portion 25 of the under sole 20 than forwardmost attachment points 72, 76. Thus, the top edge 54 more closely resembles the shape of the rear portion of the ankle 102 of the user's foot 100, in particular the heel 106 and the Achilles tendon of the foot 100. As a result, the top edge 54 more readily conforms to the rear portion of the ankle 102. In some embodiments, the top edge 54 includes a rubberized coating applied to the entire extent of the top edge 54. In some embodiments, the bottom edge 53 includes a rubberized coating applied to the entire extent of the bottom edge 53.

As can be seen in FIG. 3D, the top edge 54 has a partially sinusoidal shape, wherein upper portions of the slope of the curve near the attachment points 72, 76 are relatively shallow when viewed in the direction shown in FIG. 3D, while lower portions of the slope of the curve between the center point of the curve and the top portions are relatively steep. The steep portions of the curved top edge 54 create an overall smaller radius of curvature than the curve of the rear edge 42 such that the top edge 54 to more closely conforms to the smaller size of the Achilles tendon and heel 106 area of the foot 100 as compared to the larger size of the front portion of the ankle 102.

The bottom edge 53 of the second over-foot portion 50 is curved toward the top edge 54, as shown in FIGS. 2 and 3D. The curve of the bottom edge 53 has a larger radius of curvature than the lower portions of the curve of the top edge 54. The bottom edge 53 of the second over-foot portion 50 is not attached to the under sole 20 such that a gap 62 is formed between the bottom edge 53 and the heel portion 25 of the outer perimeter edge 22 of the under sole 20 when the second over-foot portion 50 is in the neutral, unstretched state. The gap 62 allows for adjustment of the second over-foot portion 50 when the second over-foot portion 50 overlies the rear portion of the ankle 102 of the user's foot 100. Thus, in order to increase comfort or improve the fit of the second over-foot portion 50 against the user's ankle, the user may move the second over-foot portion 50 upwardly away from the under sole 20 or downwardly toward the under sole 20 until optimal positioning is reached. Moreover, when used underwater in natural water environments having sandy waterbeds, the gap 62 allows for sand and water to quickly and easily drain out of the backside of the flexible shoe 10.

In the illustrative embodiment, a height 55 of the second over-foot portion 50 is defined by a distance between the center point of a top edge 54 of the second over-foot portion 50 and the center point of the bottom edge 53 of the second over-foot portion 50, as shown in FIGS. 2 and 3D. In at least some embodiments, the height 55 is equal to one-quarter of the length 26 of the under sole 20, which is approximate to the typical height requirement of the heel portion of a foot compared to the overall length of the foot. In some embodiments, the second over-foot portion 50 is sized to extend from a top of a heel bone 107 of the user's foot 100 to the heel portion 25 of the outer perimeter edge 22 of the under sole 20 when the foot 100 of the user is arranged in the flexible shoe 10. The increased size of the second over-foot portion 50 covers a larger portion of the heel 106 of the foot 100 than conventional back straps, thus further securing the flexible shoe 10 to the foot 100 of the user and preventing unwanted removal in rugged or wet conditions.

Similar to the first over-foot portion 40, the second over-foot portion 50 is formed of stretch-fit rubber such that the second over-foot portion 50 is flexibly resilient in the plane of the material. Specifically, the stretch-fit rubber of the second over-foot portion 50 conforms to the foot 100 of the user when the foot 100 is inserted into the flexible shoe 10. The stretch-fit rubber also has a biasing rate that biases the stretch-fit rubber to return to a neutral, unstretched state when not being stretched by the foot 100 of the user. The type of stretch-fit rubber used for the second over-foot portion 50 may be selected based on the necessary biasing rate of the application. In some embodiments, the biasing rate of the second over-foot portion 50 is greater than the biasing rate of the first over-foot portion 40 such that more force may be applied to the smaller area of the rear of the foot 100 in order to hold the shoe 10 in place.

As the stretch-fit rubber of the second over-foot portion 50 is stretched further away from its neutral, unstretched state, for example upwardly in a direction perpendicular to the resting plane of the second over-foot portion 50, the bias force forcing the material toward its unstretched state increases. Thus, the second over-foot portion 50 is configured to conform to any shape of foot 100 while contributing to securely holding the foot 100 in the flexible shoe 10.

In the illustrative embodiment, the rearmost attachment points 70, 74 at which the rear edge 42 of first over-foot portion 40 attaches to the first and second outer side perimeter edges 23, 24 of the under sole 20 are located rearward of the forwardmost attachment points 72, 76 at which the top edge 54 of the second over-foot portion 50 attaches to the first and second outer side perimeter edges 23, 24 of the under sole 20, as shown in FIGS. 1 and 2. Because of the location of the attachment points 70, 72, 74, 76, material of the first and second over-foot portions 40, 50 overlaps each other on each side of the flexible shoe 10. As a result, when the user's foot 100 is inserted into the flexible shoe 10, the overlapping portions of material of the first and second over-foot portions 40, 50 create a small side wall to further enclose and secure the user's foot 100 within the flexible shoe 10.

In operation, the user inserts his or her foot 100 into the opening defined between the rear edge 42 of the first over-foot portion 40 and the top edge 54 of the second over-foot portion 50 when the first and second over-foot portions 40, 50 are in the unstretched position, as shown in FIG. 2. The user first inserts the front portion of his or her foot 100 into the front portion of the cavity 60 defined by the first over-foot portion 40 and the under sole 20. The user may be required to lift the first over-foot portion 40 upwardly in order to insert the front portion of the foot 100. Then, due to the biasing rate of the first over-foot portion 40, the first over-foot portion 40 will conform to the instep 104 of the foot 100 and at least partially secure the flexible shoe 10 to the user's foot 100.

The user may then grip the second over-foot portion 50 and adjust the second over-foot portion 50 to wrap around the user's heel 106. The second over-foot portion 50 further secures the flexible shoe 10 to the user's foot 100. If the positioning of the second over-foot portion 50 is not ideal for the user, the user may adjust the second over-foot portion 50 upwardly or downwardly.

In at least one embodiment, the flexible shoe 10 is sized to fit a U.S. size 12 foot. In this embodiment, the length 26 of the under sole 20 is 11.5 inches. A first side length of the first over-foot portion 40 as measured from a front tip of the first over-foot portion 40 to the attachment point 70 is 7.5 inches, and a second side length of the first over-foot portion 40 as measured from a front tip of the first over-foot portion 40 to the attachment point 74 is 7.75 inches. A length of the second over-foot portion 50 as measured from rearmost attachment points of the second over-foot portion 50 to the attachment points 72, 76 is 5 inches. The instep width of the foot bed 30 as measured at the widest point of the instep portion is 5 inches. The width of the foot bed 30 as measured at the arch of the foot bed 30 is 4 inches. The width of the foot bed 30 as measured between the points at which the heel portion of the foot bed 30 begins is 3.25 inches.

A method 200 for forming the flexible shoe 10 described above is shown in FIG. 4. The method 200 includes a first step 202 of forming an under sole from ballistic nylon. The method 200 further includes a second step 204 of forming a foot bed, and a third step 206 of positioning the foot bed on an upper surface of the under sole. The method 200 further includes a fourth step 208 of forming a first over-foot portion configured to flexibly overly an instep of a foot of a user forward of an ankle of the user, and a fifth step 210 of attaching the first over-foot portion to the under sole. The method 200 further includes a sixth step 212 of forming a second over-foot portion configured to flexibly wrap around a heel of the user rearward of the ankle of the user. The under sole, the first over-foot portion, and the second over-foot portion define a cavity configured to enclose the foot of the user, and the foot bed is positioned entirely within the cavity. In some embodiments, the foot bed is first stitched to the under sole. The second over-foot portion is then stitched to the rear portion of the combined foot bed and under sole, and then finally the first over-foot portion is stitched to the front portion of the combined foot bed and under sole so as to form the flexible shoe 10 described above. In this regard, the side walls formed by the overlap of the first and second over-foot portions are supported more efficiently by stitching the second over-foot portion on first.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

The invention claimed is:

1. A flexible shoe, comprising:

an under sole formed of ballistic nylon;

a foot bed arranged on an upper surface of the under sole;

a first over-foot portion attached to the under sole and configured to flexibly overly an instep of a foot of a user forward of an ankle of the user; and a second over-foot portion configured to flexibly wrap around a heel of the user rearward of the ankle of the user, wherein the under sole, the first over-foot portion, and the second over-foot portion define a cavity configured to enclose the foot of the user, wherein the foot bed is positioned entirely within the cavity, and wherein, in a native arrangement in which the foot of the user is not arranged in the flexible shoe and the first over-foot portion and the second over-foot portion are unstretched and unflexed, the first over-foot portion and the second over-foot portion extend generally coplanar with the under sole.

2. The flexible shoe of claim 1, wherein an outer perimeter edge of the first over-foot portion that corresponds to an outer perimeter edge of the under sole is fixedly attached to an entirety of a first portion of the outer perimeter edge defined by a forward two-thirds of a forward to rearward length of the under sole.

3. The flexible shoe of claim 2, wherein a first outer side edge and a second outer side edge of the second over-foot portion that correspond to a first outer side perimeter edge and a second outer side perimeter edge of the under sole are fixedly attached to the first and second outer side perimeter edges, respectively, such that a gap is formed between a bottom edge of the second over-foot portion and a heel portion of the outer perimeter edge of the under sole.

4. The flexible shoe of claim 3, wherein the second over-foot portion is configured to extend from a top of a heel bone of the user to the heel portion of the outer perimeter edge of the under sole in response to the foot of the user being arranged in the flexible shoe.

5. The flexible shoe of claim 3, wherein a height of the second over-foot portion defined by a distance between a center point of a top edge of the second over-foot portion and a center point of the bottom edge of the second over-foot portion is equal to one-quarter of the forward to rearward length of the under sole.

6. The flexible shoe of claim 3, wherein the first over-foot portion and the second over-foot portion are flat-stitched to the outer perimeter edge of the under sole with a stitching material, the stitching material being resiliently expandable and contractable.

7. The flexible shoe of claim 3, wherein a rear edge of the first over-foot portion that extends from the first outer side perimeter edge of the under sole to the second outer side perimeter edge of the under sole is configured to flexibly surround a forward portion of the ankle of the foot of the user, and wherein a top edge of the second over-foot portion that extends from the first outer side perimeter edge of the under sole to the second outer side perimeter edge of the under sole is configured to flexibly surround a rear portion of the ankle of the foot of the user.

8. The flexible shoe of claim 7, wherein the first over-foot portion is separate from the second over-foot portion, wherein a rearmost point at which the rear edge of first over-foot portion attaches to the first outer side perimeter edge of the under sole is located rearward of a forwardmost point at which the top edge of the second over-foot portion attaches to the first outer side perimeter edge of the under sole, and wherein a rearmost point at which the rear edge of first over-foot portion attaches to the second outer side perimeter edge of the under sole is located rearward of a forwardmost point at which the top edge of the second over-foot portion attaches to the second outer side perimeter edge of the under sole.

9. The flexible shoe of claim 1, wherein the foot bed is formed of neoprene and the first over-foot portion and the second over-foot portion are formed of stretch-fit rubber.

10. A flexible shoe, comprising:

an under sole;

a foot bed arranged on an upper surface of the under sole;

a first over-foot portion attached to the under sole and configured to flexibly overly an instep of a foot of a user forward of an ankle of the user, an outer perimeter edge of the first over-foot portion that corresponds to an outer perimeter edge of the under sole being fixedly attached to an entirety of an outer perimeter edge of a forward two-thirds of a forward to rearward length of the under sole; and a second over-foot portion configured to flexibly wrap around a heel of the user rearward of the ankle of the user, a first outer side edge and a second outer side edge of the second over-foot portion that correspond to a first outer side perimeter edge and a second outer side perimeter edge of the under sole being fixedly attached to the first and second outer side perimeter edges, respectively, such that a gap is formed between a bottom edge of the second over-foot portion and a heel portion of the outer perimeter edge of the under sole, wherein the under sole, the first over-foot portion, and the second over-foot portion define a cavity configured to enclose the foot of the user, wherein the foot bed is positioned entirely within the cavity, wherein the second over-foot portion is configured to extend from a top of a heel bone of the user to the heel portion of the outer perimeter edge of the under sole in response to the foot of the user being arranged in the flexible shoe, and wherein a rear edge of the first over-foot portion that extends from the first outer side perimeter edge of the under sole to the second outer side perimeter edge of the under sole is configured to flexibly surround a forward portion of the ankle of the foot of the user, and wherein a top edge of the second over-foot portion that extends from the first outer side perimeter edge of the under sole to the second outer side perimeter edge of the under sole is configured to flexibly surround a rear portion of the ankle of the foot of the user.

11. The flexible shoe of claim 10, wherein a height of the second over-foot portion defined by a distance between a center point of a top edge of the second over-foot portion and a center point of the bottom edge of the second over-foot portion is equal to one-quarter of the forward to rearward length of the under sole.

12. The flexible shoe of claim 10, wherein the under sole is formed of ballistic nylon.

13. The flexible shoe of claim 12, wherein the foot bed is formed of neoprene and the first over-foot portion and the second over-foot portion are formed of stretch-fit rubber.

14. The flexible shoe of claim 10, wherein the first over-foot portion and the second over-foot portion are flat-stitched to the outer perimeter edge of the under sole with a stitching material, the stitching material being resiliently expandable and contractable.

15. The flexible shoe of claim 10, wherein the first over-foot portion is separate from the second over-foot portion, wherein a rearmost point at which the rear edge of first over-foot portion attaches to the first outer side perimeter edge of the under sole is located rearward of a forwardmost point at which the top edge of the second over-foot portion attaches to the first outer side perimeter edge of the under sole, and wherein a rearmost point at which the rear edge of first over-foot portion attaches to the second outer side perimeter edge of the under sole is located rearward of a forwardmost point at which the top edge of the second over-foot portion attaches to the second outer side perimeter edge of the under sole.

16. The flexible shoe of claim 10, wherein the heel portion of the outer perimeter edge of the under sole is located rearward of the second over-foot portion in the use arrangement.

17. The flexible shoe of claim 10, wherein a height of the gap as measured between the bottom edge of the second over-foot portion and the heel portion of the outer perimeter edge of the under sole is larger in the native arrangement than in the use arrangement.

18. The flexible shoe of claim 10, wherein the first and second over-foot portions are configured to be arranged in (i) a native arrangement in which the foot of the user is not arranged in the flexible shoe and the first over-foot portion, the second over-foot portion are unstretched and unflexed, and the first over-foot portion and the second over-foot portion extend generally coplanar with the under sole, and (ii) a use arrangement in which the foot of the user is arranged in the flexible shoe and the first and second over-foot portions flexibly overlay the foot of the user.

* * * * *